US008011656B2

(12) United States Patent
Morita

(10) Patent No.: US 8,011,656 B2
(45) Date of Patent: Sep. 6, 2011

(54) IMAGE FORMING APPARATUS

(75) Inventor: Ryo Morita, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 205 days.

(21) Appl. No.: 12/561,959

(22) Filed: Sep. 17, 2009

(65) Prior Publication Data

US 2010/0066009 A1 Mar. 18, 2010

(30) Foreign Application Priority Data

Sep. 18, 2008 (JP) ..... 2008-239277

(51) Int. Cl.
*B65H 5/00* (2006.01)

(52) U.S. Cl. ..... 271/264; 271/69; 271/306

(58) Field of Classification Search ..... 271/264, 271/69, 306, 207, 220
See application file for complete search history.

(56) References Cited

U.S. PATENT DOCUMENTS 3,674,256 A * 7/1972 Brookhyser ..... 271/306
3,704,882 A * 12/1972 Brookhyser ..... 271/306
2006/0220304 A1* 10/2006 Miyazaki et al. ..... 271/207
2007/0176357 A1* 8/2007 Horio et al. ..... 271/220
2007/0241495 A1* 10/2007 Hosoya et al. ..... 271/220
2008/0122165 A1* 5/2008 Shirasaki ..... 271/220
2009/0218757 A1* 9/2009 Terashima ..... 271/225

FOREIGN PATENT DOCUMENTS

JP 2003-276910 10/2003
JP 3950723 4/2007

* cited by examiner

*Primary Examiner* — David H Bollinger
(74) *Attorney, Agent, or Firm* — Morrison & Foerster LLP

(57) ABSTRACT

There is provided an image forming apparatus which does not need height adjustment of the main body and the sheet post-processing device at the time of attaching the sheet post-processing device to the main body and which can prevent jam from occurring while securing the conveying force to convey paper sheets. In an image forming apparatus 11 including a main body 11*a* having a delivery section 41 and a sheet post-processing device 12 having a reception section 43 for receiving paper sheets S, the delivery section 41 has a first paper conveying unit 46 for conveying paper sheets S toward the reception section 43, the reception section 43 has a pair of fixed guides 49 for receiving the paper sheets S conveyed from the first paper conveying unit 46, a pair of movable guides 48 is provided between the first paper conveying unit 46 of the delivery section 41 and the pair of fixed guides 49 of the reception section 43, so that when the sheet post-processing device 12 is brought close to the main body 12*a*, the pair of movable guides 48 comes into sliding contact with the pair of fixed guides 49 and rotates around a shaft.

9 Claims, 9 Drawing Sheets

(a)

(b)

(a)

(b)

(a)

(b)

IMAGE FORMING APPARATUS

This application is based on application No. 2008-239277 filed in Japan on Sep. 18, 2008, the contents of which are hereby incorporated by reference.

BACKGROUND OF THE INVENTION

The present invention relates to an image forming apparatus including an image forming apparatus main body such as copying machines and laser beam printers and a sheet post-processing device which is attached to the main body as a different body which applies post processing such as punching and stapling to paper sheets with images formed thereon.

Conventionally, when a post-processing device is mounted on a main body, it is necessary to perform height adjustment so that a sheet path on the main body side and a sheet path on the sheet post-processing device side have an identical height, because paper sheets cannot be fed from the main body to the sheet post-processing device if the sheet path on the main body side and the sheet path on the sheet post-processing device side have a different height.

For example, proposed in Japanese Patent JP3950723B is an image forming apparatus and a sheet post-processing device in which a relay guide plate is placed between the outlet of the image forming apparatus and the inlet of the sheet post-processing device so that paper sheets can be fed from the image forming apparatus to the sheet post-processing device.

However, the image forming apparatus and the sheet post-processing device described in JP3950723B has a problem that unless height adjustment is performed at the time of attaching the post-processing device to the image forming apparatus, the outlet of the image forming apparatus shifts in a vertical direction from a position of the relay guide plate and thereby paper sheets cannot be fed from the image forming apparatus to the sheet post-processing device.

The height adjustment involves time and effort, and therefore in order to make height adjustment unnecessary, a large space needs to be provided between a delivery section of the main body which delivers paper sheets to the sheet post-processing device and a reception section of the sheet post-processing device which receives the paper sheets delivered from the main body.

However, when the large space is formed, the top end of a curled paper sheet S comes into contact with a guide 81 and is widely bent as shown in FIG. 9, and this causes a problem that a jam is prone to occur. Moreover, forming the large space causes a problem that at the time of registering paper sheets, a paper sheet S which is in contact with a nip portion of a roller 82 sags into S shape as shown in FIG. 10 and forms a loop, or sags as shown in FIG. 11 and forms an excessively large loop so that the force of conveying the paper sheet S in an arrow direction is lost.

The term "registering (registration) of the paper sheet" herein refers to the operation of arranging the paper sheet S so that the top end of the paper sheet S is made parallel with the roller 82 by the process in which while one side of the paper sheet S conveyed aslant with respect to roller 82 is brought into contact with the nip portion of the roller 82 to form a loop as shown in FIG. 12, the roller 82 is driven to send out the paper sheet S the moment that other side of the paper sheet S reaches the nip portion.

SUMMARY OF INVENTION

In view of the conventional problems, an object of the present invention is to provide an image forming apparatus including a main body and a sheet post-processing device which does not need height adjustment of the main body and the sheet post-processing device at the time of attaching the sheet post-processing device to the main body, and which has a smaller space between a delivery section and a reception section so that jam can be prevented from occurring while the conveying force to convey paper sheets can be secured.

In order to solve the problems, an image forming apparatus in one aspect of the invention includes a main body having a delivery section for delivering a paper sheet with a toner image transferred thereon to an outside, and a sheet post-processing device having a reception section for receiving the paper sheet delivered from the delivery section of the main body, wherein the delivery section has a first sheet path for conveying the paper sheet into the delivery section, and a first paper conveying unit for conveying the paper sheet toward the reception section, wherein the reception section has a pair of fixed guides which is fixed so as to open to the first paper conveying unit for receiving the paper sheet conveyed from the first paper conveying unit, and a second sheet path which continues from the pair of fixed guides, and wherein a pair of movable guides is provided between the first paper conveying unit of the delivery section and the pair of fixed guides of the reception section so as to be able to rotate around a horizontal shaft, and when the sheet post-processing device is brought close to the main body, the pair of movable guides comes into sliding contact with the pair of fixed guides and rotates around the shaft.

When the sheet post-processing device is brought close to the main body, the pair of movable guides rotatably provided between the first paper conveying unit and the pair of fixed guides of the delivery section comes into sliding contact with the pair of fixed guides, and rotates around a shaft. Accordingly, even if the first sheet path and the second sheet path are different in height, the pair of movable guides can guide a paper sheet between the first paper conveying unit and the pair of fixed guides and can convey the paper sheet toward the reception section. Therefore, the sheet post-processing device can be attached to the main body without execution of height adjustment.

The shaft should preferably be provided in an end portion of the pair of movable guides opposite to the pair of fixed guides.

It is preferable that a second paper conveying unit is provided which conveys the paper sheet, which are conveyed into the reception section from the first paper conveying unit via the pair of movable guides and the pair of fixed guides, toward a downstream in the sheet post-processing device, and that the second paper conveying unit comes into contact with one side of the paper sheet at a nip portion.

Since the second paper conveying unit comes into contact with one side of the paper sheet at the nip portion, the paper sheet conveyed aslant can be registered.

It is preferable that the pair of movable guides includes: a slide contact guide which comes into sliding contact with the pair of fixed guides and rotates around a shaft when the sheet post-processing device is brought close to the main body; and a follower guide which follows after rotation of the slide contact guide and rotates around a shaft, and that a notch portion is provided in a downstream end portion of the follower guide, and an elastic member is placed on the notch portion.

It is preferable that the pair of movable guides includes: a slide contact guide which comes into sliding contact with the pair of fixed guides and rotates around a shaft when the sheet post-processing device is brought close to the main body; and a follower guide which follows after rotation of the slide contact guide and rotates around a shaft, and that a notch portion is provided in a downstream end portion of the follower guide, and a rotating member which rotates around a shaft from a horizontal state to the state in contact with the notch portion is placed on the notch portion.

The elastic member or the rotating member is placed on the notch portion, so that a paper sheet, which comes into contact with the second paper conveying unit for registering and thereby tends to sag and form a loop, can be pressed, and therefore it becomes possible to prevent formation of an excessively large loop and to form a loop suitable for conveyance.

The follower guide should preferably be biased toward the slide contact guide by a movement restraining member placed in a stationary section of the main body.

The follower guide is biased toward the slide contact guide, and therefore as the slide contact guide rotates, the follower guide can also rotate following after the rotation of the slide contact guide.

It is preferable that a projective portion extending toward either one of the slide contact guide and the follower guide is provided in the other guide so that a paper sheet path is formed between the slide contact guide and the follower guide.

The projective portion extending toward either one of the slide contact guide and the follower guide is provided in the other guide to secure a predetermined space between the slide contact guide and the follower guide, so that a sheet path can be formed to convey paper sheets.

With the above configuration, the pair of movable guides of the delivery section comes into sliding contact with the pair of fixed guides and rotates around a shaft when the sheet post-processing device is brought close to the main body. Accordingly, even if the first sheet path and the second sheet path are different in height, the pair of movable guides can guide a paper sheet between the first paper conveying unit and the pair of fixed guides and can convey the paper sheet toward the reception section. Therefore, the sheet post-processing device can be attached to the main body without execution of height adjustment.

Since the second paper conveying unit comes into contact with one side of a paper sheet at the nip portion, the paper sheet conveyed aslant can be registered, and since the elastic member or the rotating member is placed on the notch portion, it becomes possible to form a loop suitable for conveyance.

BRIEF DESCRIPTION OF DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

Embodiments of the present invention will be described in detail below with reference to the accompanying drawings.

Figure 1:
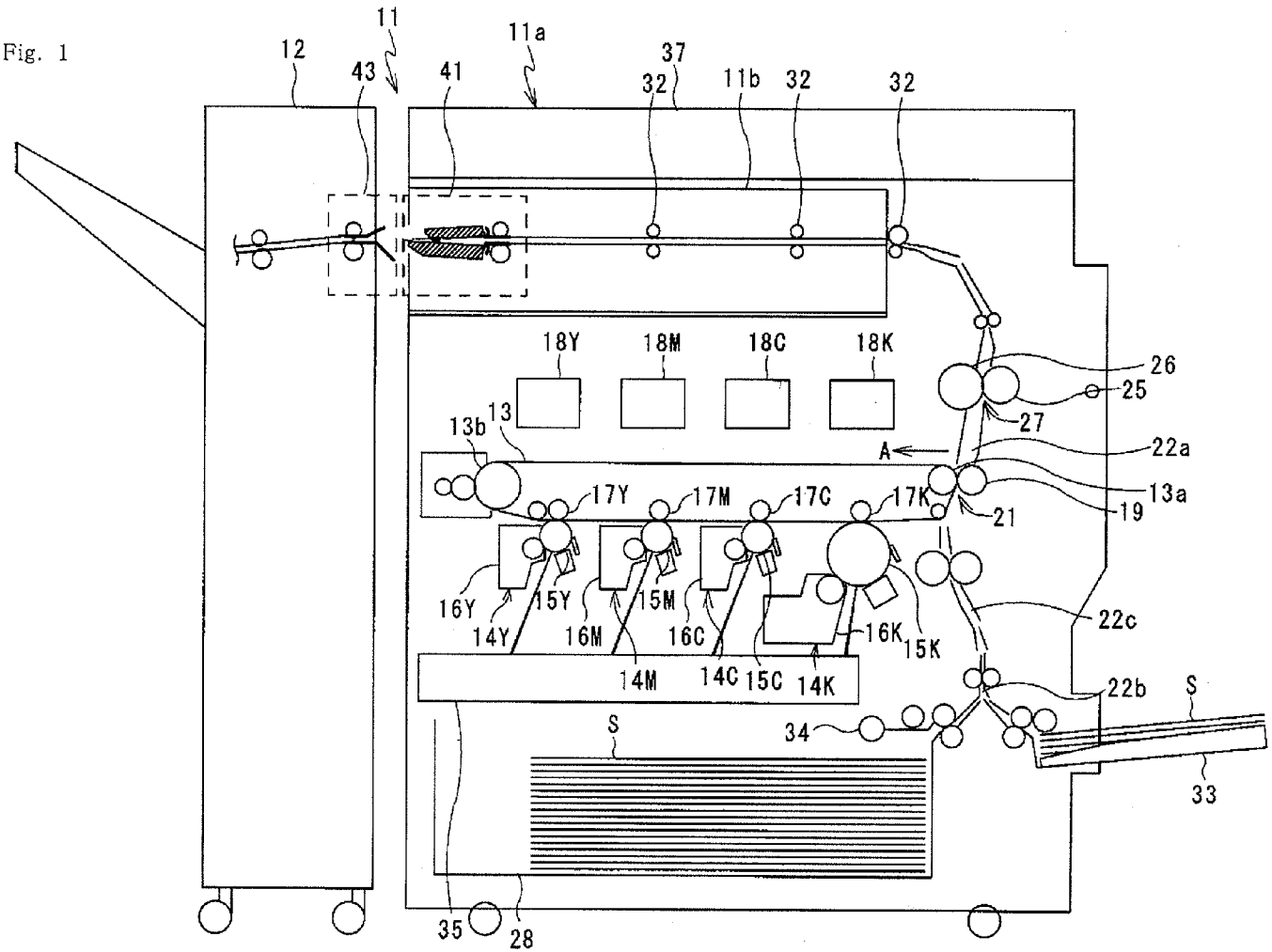
FIG. 1 is a schematic view of an image forming apparatus in one embodiment of the invention.

FIG. 1 shows an image forming apparatus 11 according to an embodiment of the invention. The image forming apparatus 11 is composed of a main body 11*a* and a sheet post-processing device 12. First, the schematic configuration of the main body 11*a* will be explained. The main body 11*a* has an intermediate transfer belt 13 as an image carrier at a generally central portion inside the main body 11*a*. The intermediate transfer belt 13 is supported by outer peripheral portions of rollers 13*a*, 13*b* and rotationally driven in an arrow A direction. Under a lower horizontal portion of the intermediate transfer belt 13, four print units 14Y, 14M, 14C, 14K corresponding to individual colors of yellow (Y), magenta (M), cyan (C) and black (K), respectively, are placed in array along the intermediate transfer belt 13. The print units 14Y, 14M, 14C, 14K have photoconductor drums 15Y, 15M, 15C, 15K, developing units 16Y, 16M, 16C, 16K, and primary transfer rollers 17Y, 17M, 17C, 17K facing the photoconductor drums 15Y, 15M, 15C, 15K across the intermediate transfer belt 13, respectively. The developing units 16Y, 16M, 16C, 16K communicate with toner cartridges 18Y, 18M, 18C, 18K, respectively, provided upward with the intermediate transfer belt 13 interposed therebetween. A secondary transfer roller 19 is set in pressure contact with a portion of the intermediate transfer belt 13 supported by the driving roller 13*a*, and a nip portion between the secondary transfer roller 19 and the intermediate transfer belt 13 serves as a transfer portion 21. Further downstream of the sheet path 22*a* are provided a fixing roller 26 and a pressure roller 25 facing the fixing roller 26, where a pressure contact portion therebetween serves as a fixing nip area 27.

Sheet feed sections 28 are placed so as to be lapped over in a lower part of the main body 11*a*. Paper sheets S loaded and accommodated in the sheet feed sections 28 are fed out to a sheet path 22*b* one by one, starting with the topmost sheet. A manual sheet feed unit 33 is provided at a side portion of the main body 11*a*. Sheet feed rollers 34 for feeding a sheet S as shown typically by FIG. 1 are provided on the sheet path 22*b* derived from the manual sheet feed unit 33 and the sheet feed sections 28. In addition, reference sign 35 denotes an exposure section 35 which exposes to light the photoconductor drums 15Y, 15M, 15C, 15K according to image signals.

Next, an outlined operation of the main body 11*a* constructed as shown above is described below. Color print data acquired by reading an image with an image reader section 37 or image data outputted from a personal computer or the like, after subjected to specified signal processing, is fed to the exposure section 35 as image signals, of individual colors of yellow (Y), magenta (M), cyan (C) and black (K). Laser beams modulated by the image signals are projected onto their respective photoconductor drums 15Y, 15M, 15C, 15K, respectively, by the exposure section 35, by which electrostatic latent images are formed. The electrostatic latent images on the photoconductor drums 15Y, 15M, 15C, 15K are developed by the developing units 16Y, 16M, 16C, 16K, respectively, by which toner images of yellow, magenta, cyan and black are formed. The formed toner images of yellow, magenta, cyan and black are superimposed and thereby primarily transferred sequentially on the moving intermediate transfer belt 13 by action of the primary transfer rollers 17Y, 17M, 17C, 17K. The superimposed toner images formed on the intermediate transfer belt 13 in this way reach the transfer portion 21 as the intermediate transfer belt 13 moves. At this transfer portion 21, the superimposed toner images of the individual colors are secondarily transferred by action of the secondary transfer roller 19 collectively to the sheet S fed from the sheet feed section 28*a* or 28*b* or the manual sheet feed unit 33. Subsequently, the sheet S on which the toner images have been secondarily transferred reaches the fixing nip area 27. At the fixing nip area 27, the toner images are fixed to the sheet S by action of the fixing roller 26 and the pressure roller 25. The sheet S on which the toner images have been fixed is discharged by a sheet discharge roller 32 to a delivery section 41 provided in the downstream of a relay conveyor unit 11*b* which constitutes a part of the main body 11*a*.

The sheet post-processing device 12 receives the paper sheet S conveyed from the delivery section 41 and performs post-processing such as punching and stapling. In the upstream of the sheet post-processing device 12, a reception section 43 is provided which receives paper sheets S conveyed from the main body 11*a*.

Figure 2:
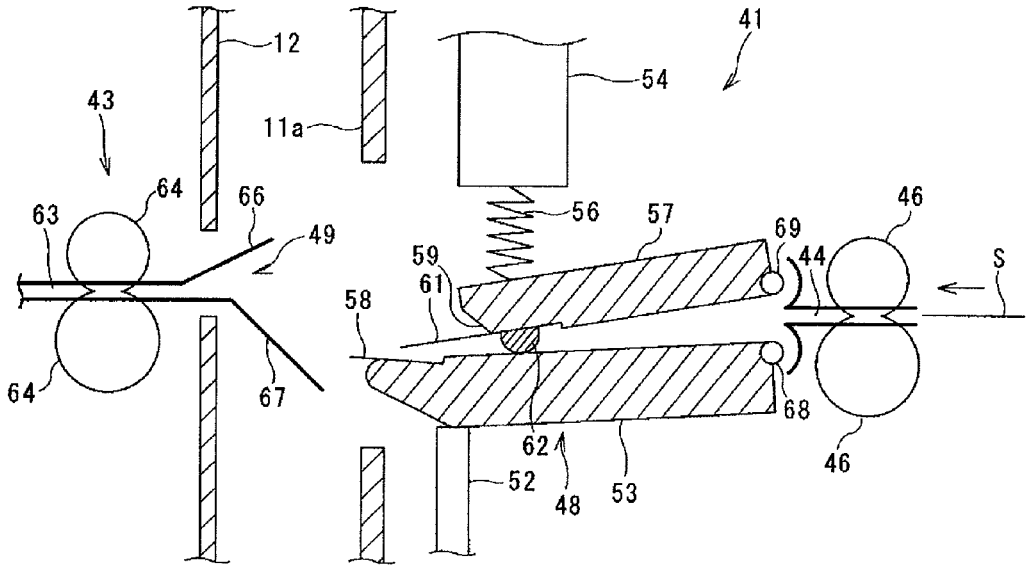
FIG. 2 is an expanded sectional view showing a delivery section and a reception section in the state where a main body and a sheet post-processing device of FIG. 1 are separated and the height of a sheet path on the main body side is lower than the height of the sheet post-processing device.

As shown in FIG. 2, the delivery section 41 provided on the most downstream side in the main body 11*a* is composed of a first sheet path 44 provided on the upstream side for passing the paper sheets S, a pair of first paper conveying rollers 46 as the first paper conveying unit provided in the first sheet path 44, and a pair of movable guides 48 provided downstream from the first paper conveying roller 46. Paper sheets S are conveyed by the first paper conveying roller 46 in an arrow direction and are guided by the pair of movable guides 48, so that they move toward the reception section 43.

The first paper conveying roller 46 is a publicly known conveying roller which provides conveying force to paper sheets S via the nip portion to convey the paper sheets S.

The pair of movable guides 48 is composed of a slide contact guide 53 which comes into contact with the upper end of a supporter 52 of the main body 11*a* and is supported thereby, and a follower guide 57 biased downward by a spring 56 which is a movement restraining member provided in the lower end of a stationary section 54 of the main body 11*a*.

The slide contact guide 53 is rotatably supported by a shaft 68 provided at the upstream top end, and an extending portion 58 made of polyester films is provided at the downstream top end.

The follower guide 57 is rotatably supported by a shaft 69 provided at the upstream top end, and a notch portion 59 opening toward the reception section 43 is provided at the downstream top end. An elastic member 61 made of polyester films extending toward a paper feed direction is provided in the notch portion 59. A projective portion 62 projecting toward the slide contact guide 53 is provided on the lower surface of the follower guide 57. The follower guide 57 biased downward by the spring 56 is positioned upon contact of the projective portion 62 with a position of the slide contact guide 53 outside the paper feed range.

The reception section 43 is composed of a pair of fixed guides 49 which is fixed so as to open toward the delivery section 41, a second sheet path 63 which continues to the pair of fixed guides 49, and a second paper conveying roller 64 which is a second paper conveying unit provided in the second sheet path 63.

The pair of fixed guides 49, which is a publicly known guide pair, is composed of an upward guide 66 extending upward from the sheet post-processing device 12 and a downward guide 67 extending downward.

The second paper conveying roller 64 is a publicly known conveying roller which provides conveying force to paper sheets S via the nip portion to convey the paper sheets S. The second paper conveying roller 64 comes into contact with a paper sheet S conveyed from the delivery section 41 via the pair of fixed guides 49, and registers the paper sheet S.

Operation of the delivery section 41 and the reception section 43 will be described hereinafter.

Figure 3:
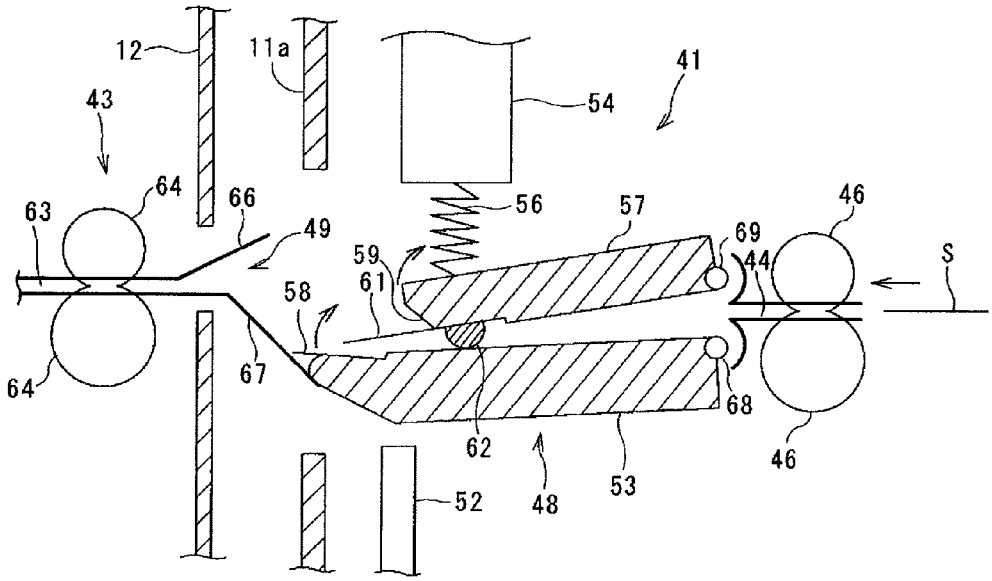
FIG. 3 is an expanded sectional view showing the delivery section and the reception section in the state where the sheet post-processing device is brought close to the main body of FIG. 2.
Figure 4:
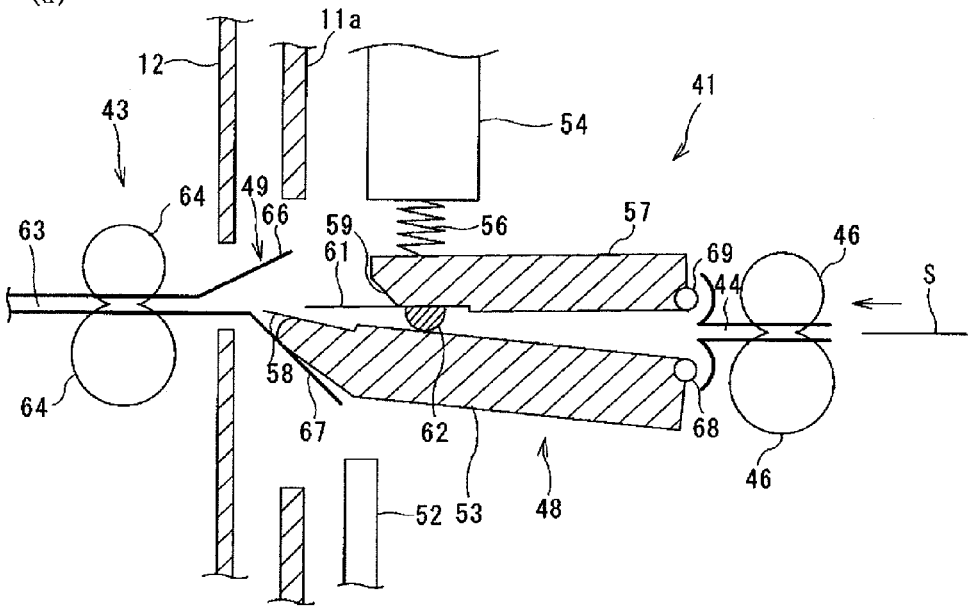
FIG. 4A is an expanded sectional view showing the delivery section and the reception section in the state where the sheet post-processing device is attached to the main body of FIG. 3.
FIG. 4B is an expanded sectional view showing a paper sheet being registered by rollers in this state.
Figure 4:
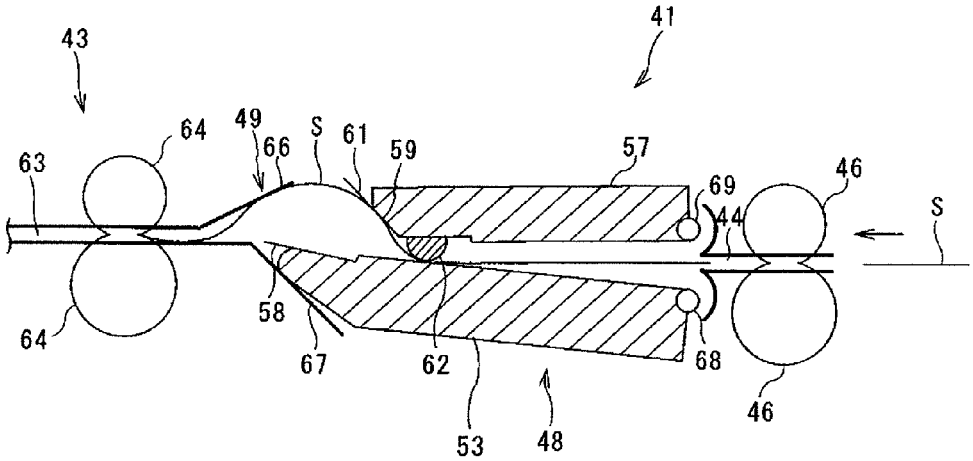

In the case where the height of the first sheet path 44 is lower than the height of the second sheet path 63 (as in the state shown in FIG. 2); upon movement of the sheet post-processing device 12 toward the main body 11*a* for attachment of the sheet post-processing device 12, first, as shown in FIG. 3, the top end of the slide contact guide 53 comes into sliding contact with the downward guide 67 and rotates around the shaft 68 in an arrow direction. Then, the follower guide 57 biased toward the slide contact guide 53 by the spring 56 also rotates around the shaft 69 following after the slide contact guide 53. Further, when the sheet post-processing device 12 is moved toward the main body 11*a* and the sheet post-processing device 12 is attached to the main body 11*a*, the downstream top end of the slide contact guide 53 which rotates while coming into sliding contact with the downward guide 67 is aligned with the height of the second sheet path 63 as shown in FIG. 4A, while the follower guide 57 rotates similarly and provides a predetermined distance to the slide contact guides 53 via the projective portion 62, so that a sheet path is formed. Accordingly, a paper sheet S conveyed from the first sheet path 44 is guided by the slide contact guide 53 and the follower guide 57 as well as the extending portion 58 and the elastic member 61 provided at the top ends thereof, and reaches the second paper conveying roller 64 via the pair of fixed guides 49.

The paper sheet S which reached the second paper conveying roller 64 is registered by the second paper conveying roller 64, and forms a loop as shown in FIG. 4B. At this time, the elastic member 61 is bent until it comes into contact with the notch portion 59, and presses the paper sheet S with its elasticity. This makes it possible to prevent formation of an excessively large loop and to form a loop suitable for conveyance.

Figure 5:
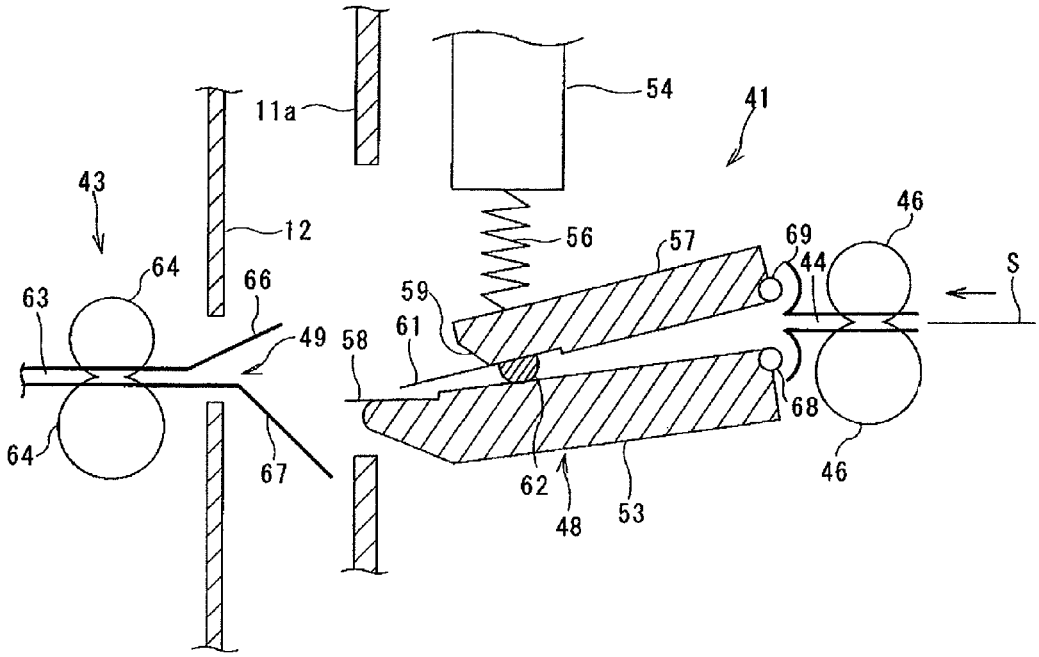
FIG. 5 is an expanded sectional view showing the delivery section and the reception section in the state where the main body and the sheet post-processing device of FIG. 1 are separated and the height of the sheet path on the main body side is higher than the height of the sheet post-processing device.
Figure 6:
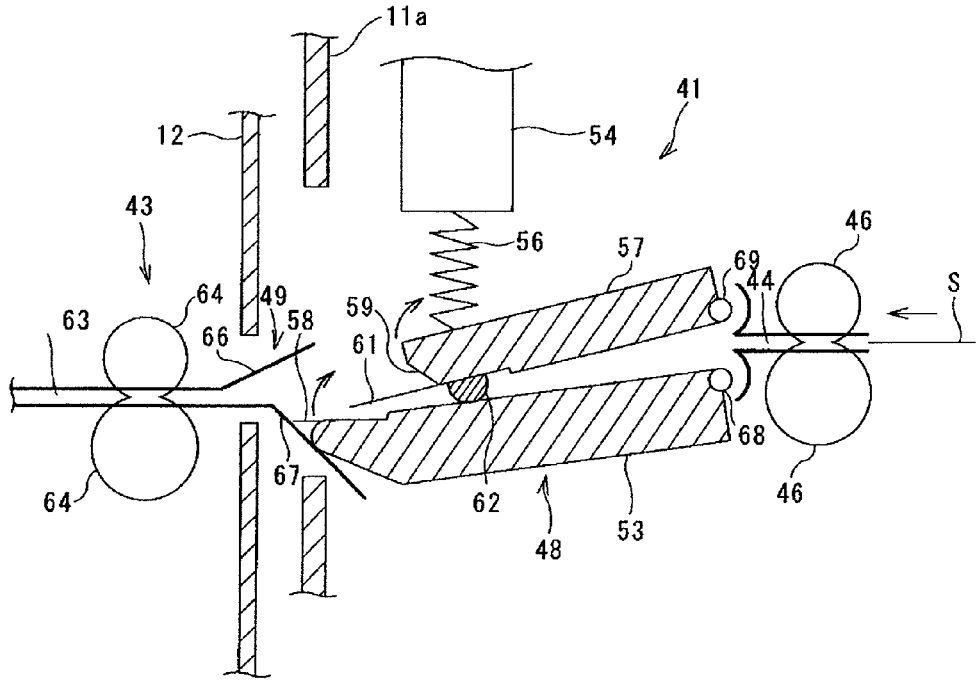
FIG. 6 is an expanded sectional view showing the delivery section and the reception section in the state where the sheet post-processing device is brought close to the main body of FIG. 5.
Figure 7:
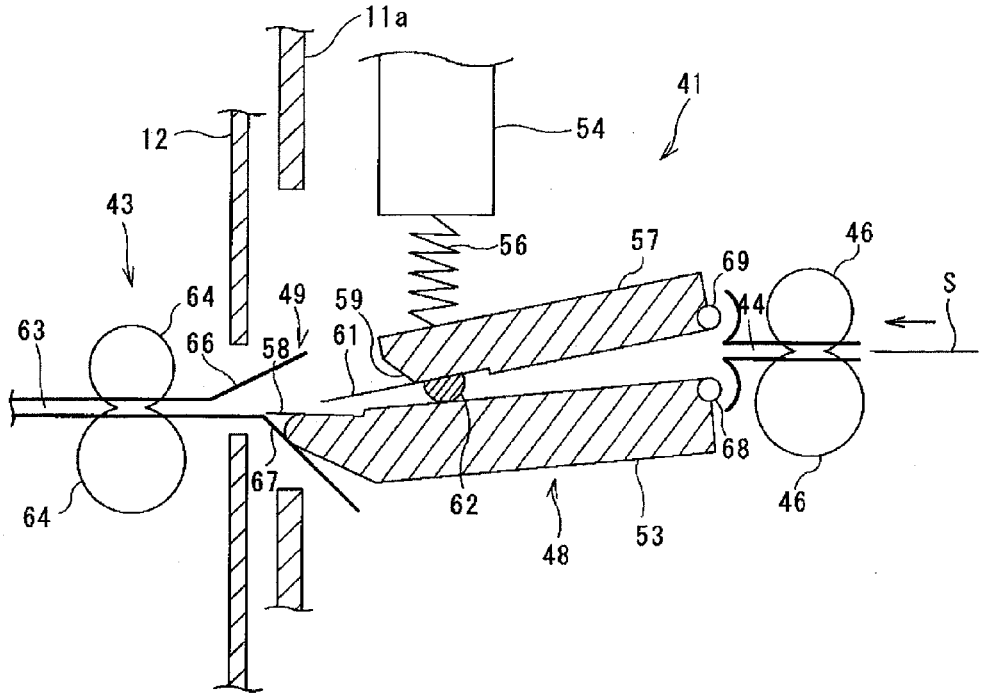
FIG. 7 is an expanded sectional view showing the delivery section and the reception section in the state where the sheet post-processing device is attached to the main body of FIG. 6.

In the case where the height of the first sheet path 44 is higher than the height of the second sheet path 63, upon movement of the sheet post-processing device 12 toward the main body 11*a* for attachment of the sheet post-processing device 12, the same operation as the case where the height of the first sheet path 44 is lower than the height of the second sheet path 63 is performed. That is, as shown in FIG. 5 through FIG. 7, the slide contact guide 53 comes into sliding contact with the downward guide 67 and rotates in an arrow direction. Further, when the sheet post-processing device 12 is moved toward the main body 11*a* and the sheet post-processing device 12 is attached to the main body 11*a*, the downstream top end of the slide contact guide 53 is aligned with the height of the second sheet path 63, while the follower guide 57 also rotates similarly, and provides a predetermined distance to the slide contact guides 53 via the projective portion 62, so that a sheet path is formed.

Accordingly, the paper sheet S conveyed from the first sheet path 44 is guided by the slide contact guide 53 and the follower guide 57, and is conveyed to the reception section 43. Therefore, even if the first sheet path 44 and the second sheet path 63 are different in height when the sheet post-processing device 12 is brought close to the main body 11*a* for attachment of the sheet post-processing device 12, the slide contact guide 53 and the follower guide 57 can guide and convey the paper sheet S and toward the reception section 43. Therefore, the sheet post-processing device 12 can be attached to the main body 11*a* without execution of height adjustment.

Since the second paper conveying roller 64 comes into contact with one side of a paper sheet S at the nip portion, the paper sheet S conveyed aslant can be registered.

The follower guide 57 is biased toward the slide contact guide 53, and therefore as the slide contact guide 53 rotates, the follower guide 57 can also rotate following after the rotation of the slide contact guide 53.

Since the projective portion 62 projecting toward the slide contact guide 53 is provided on the lower surface of the follower guide 57, a predetermined space can be secured between the slide contact guide 53 and the follower guide 57 to form a sheet path, and the paper sheets S can be conveyed.

It should be understood that this invention is not limited to the above embodiments.

Figure 8:
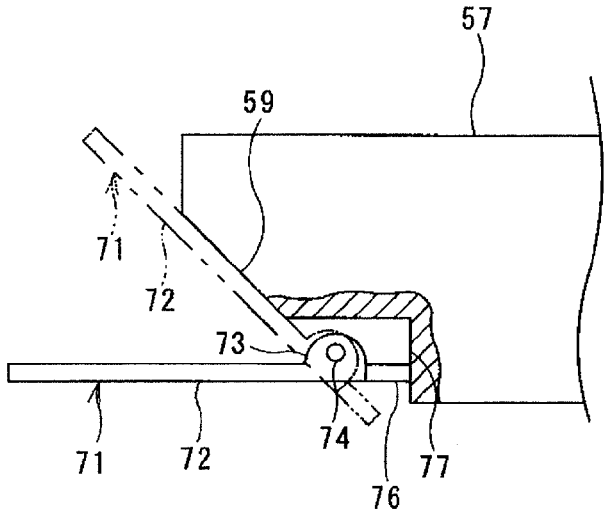
FIG. 8A is a side view showing the state where a rotating member which is a modified example of an elastic member placed in a notch portion of a follower guide is placed and rotated.
FIG. 8B is a top view of FIG. 8A.
Figure 8:
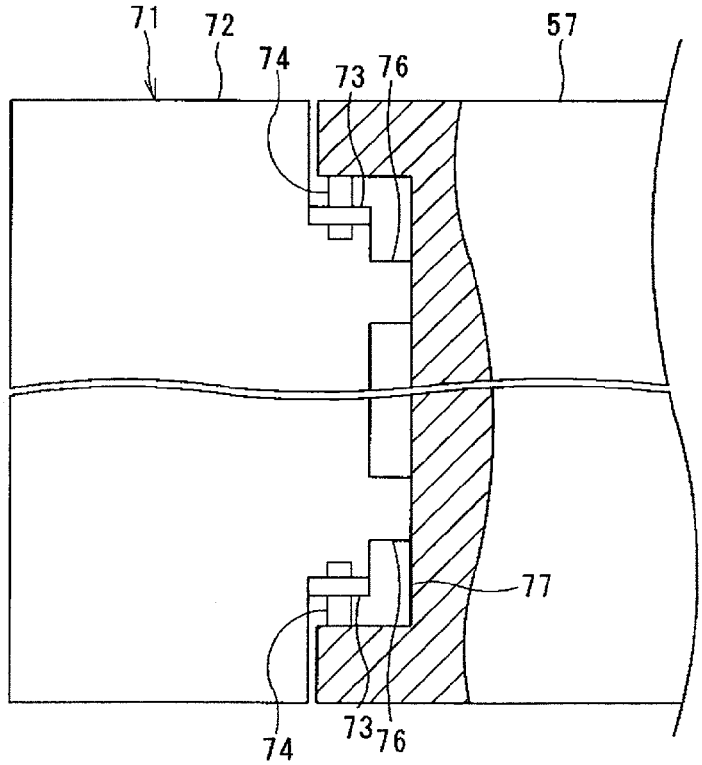
Figure 9:
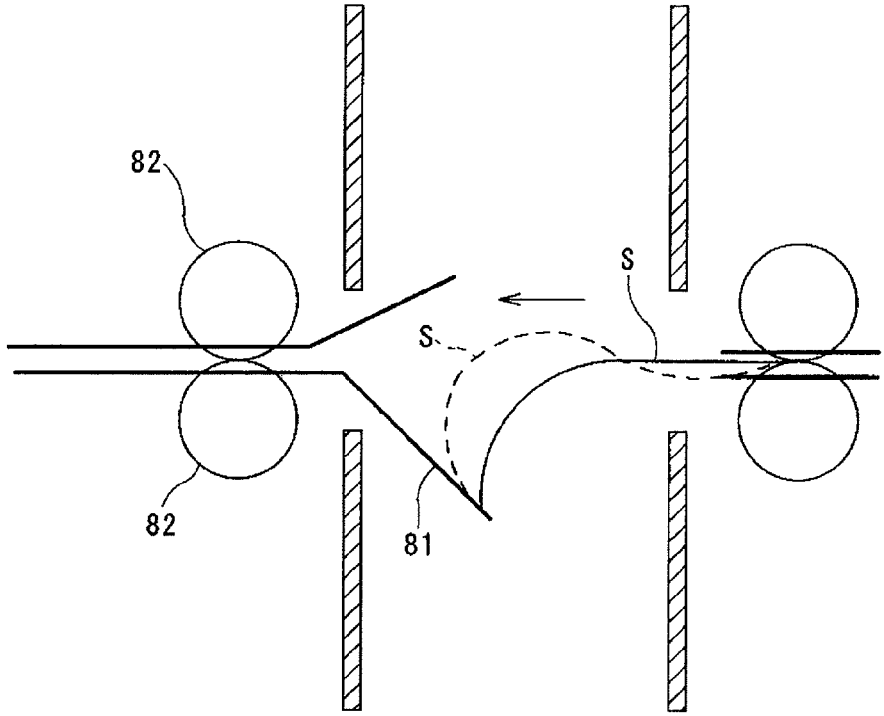
FIG. 9 is a side view showing a paper sheet being jammed between a conventional delivery section and reception section.
Figure 10:
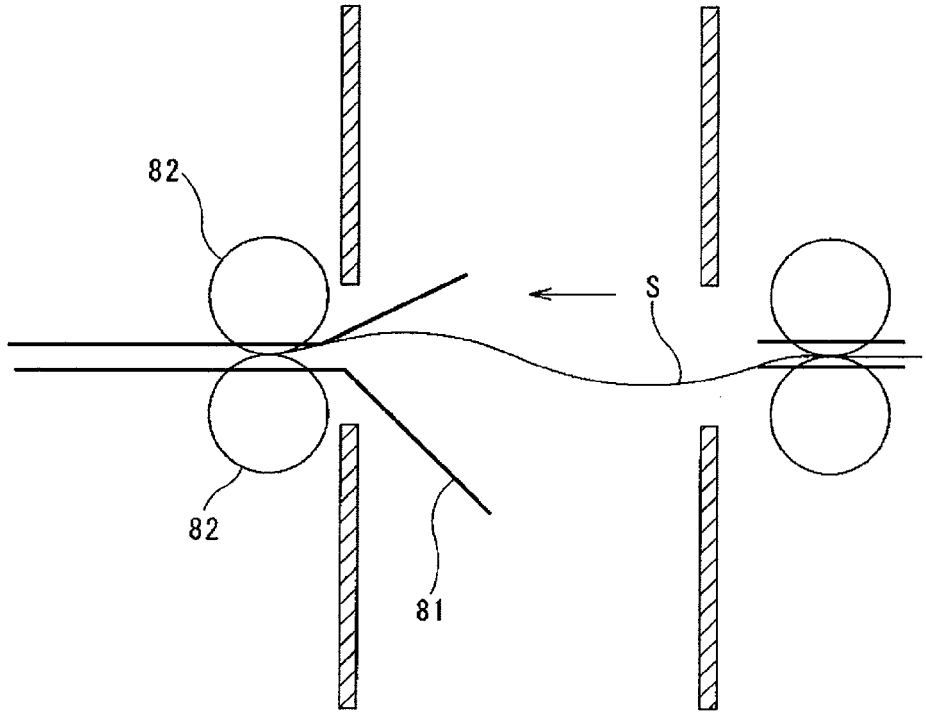
FIG. 10 is a side view showing the state where a paper sheet sagged between the conventional delivery section and the reception section and an S-shaped loop is formed.
Figure 11:
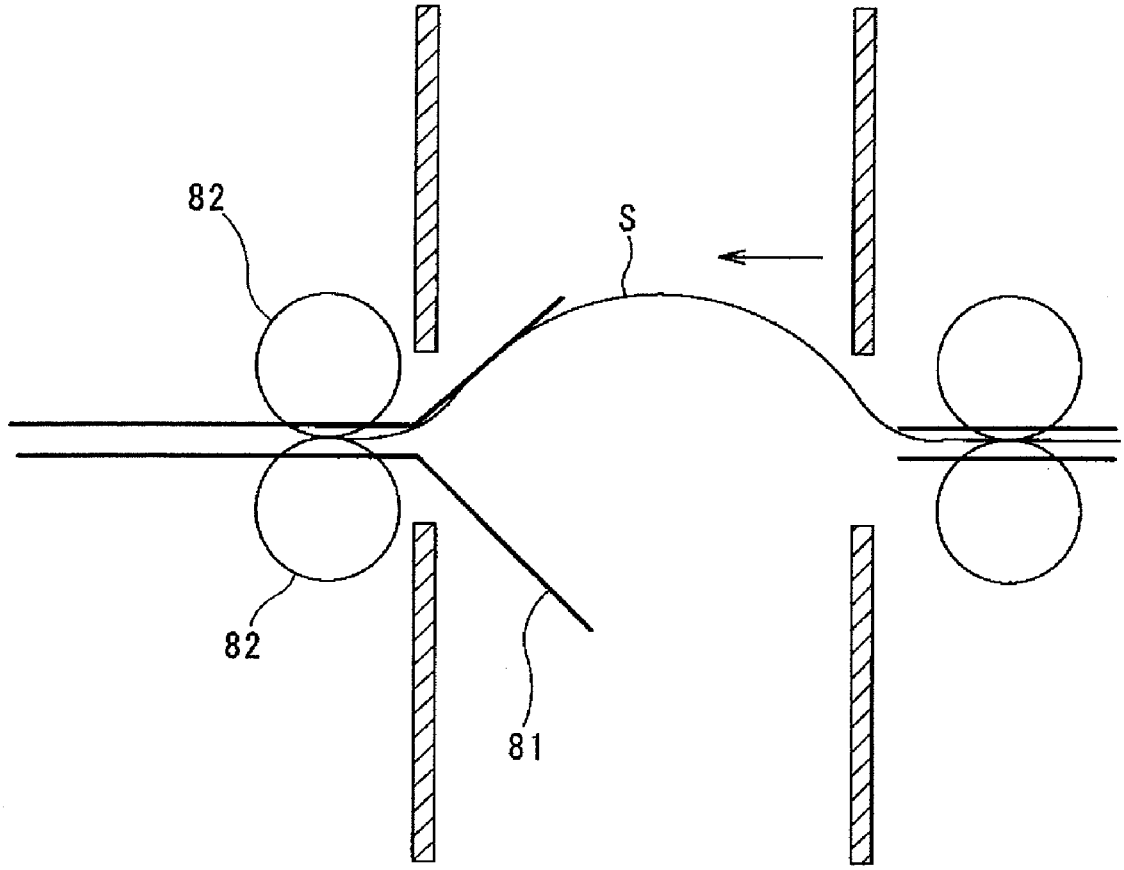
FIG. 11 is a side view showing the state where a paper sheet sagged between the conventional delivery section and the reception section and a large loop is formed.
Figure 12:
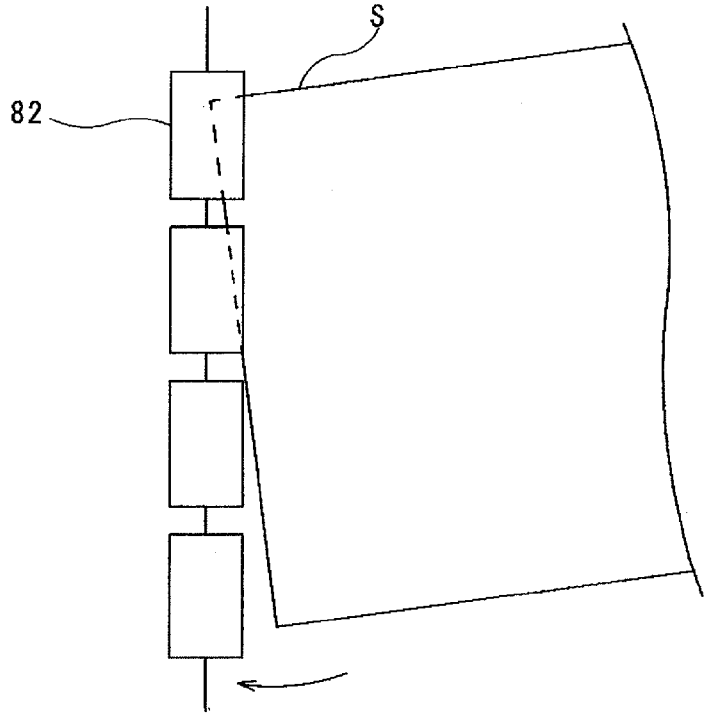
FIG. 12A is a top view showing a paper sheet conveyed aslant being registered by rollers.
FIG. 12B is a top view showing the state where the registration is completed.
Figure 12:
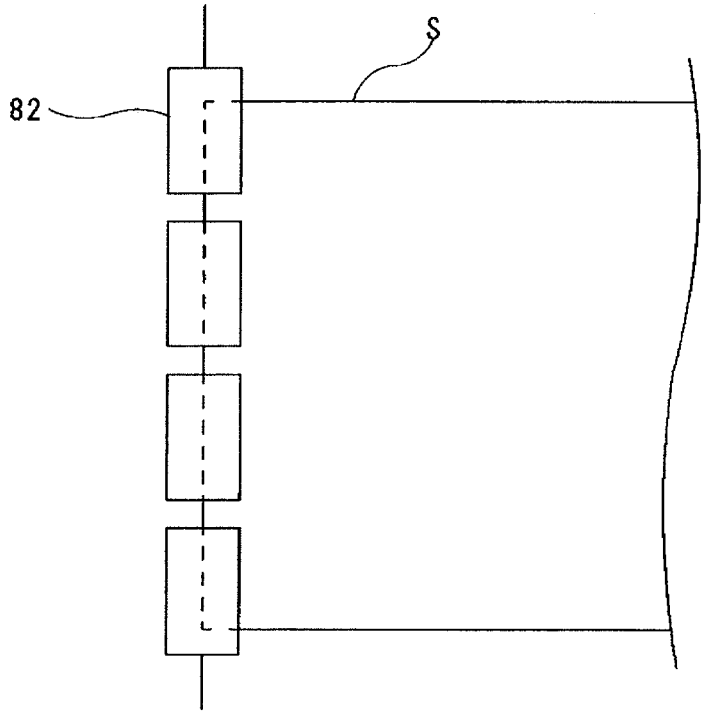

As for the notch portion 59 of the follower guide 57, the elastic member 61 may be replaced with a rotating member 71 shown in FIG. 8. The rotating member 71, which is composed of a plate 72 and a rising portion 73 rising from the plate 72, is mounted on the follower guide 57 via a hinge shaft 74. The rotating member 71 is biased downward by its own weight or by a coil spring (not shown). A protruding portion 76 is provided in an outer edge of the rotating member 71 which faces the notch portion 59, and the protruding portion 76 comes into contact with a step portion 77 provided in the notch portion 59, so that the rotating member 71 is kept horizontal. The rotating member 71 rotates around the hinge shaft 74 from the horizontally kept state to the state in contact with the notch portion 59.

Since the rotating member 71 is biased downward, a paper sheet S, which comes into contact with the second paper conveying roller 64 for registering and thereby tends to sag and form a loop, can be pressed downward, and so it becomes possible to prevent formation of an excessively large loop and to form a loop suitable for conveyance.

In this embodiment, the slide contact guide 53 is provided on a lower part on the main body 11*a* side of the image forming apparatus 11, and the follower guide 57 is provided in an upper part, while the downward guide 67 is provided in a lower part of the sheet post-processing device 12 and the upward guide 66 is provided in an upper part. However, the image forming apparatus structured to have these upper and lower guides reversely placed can also be functioned as is the case of the aforementioned embodiment.

Although the relay conveyor unit 11*b* is provided as a part of the main body 11*a* of the image forming apparatus 11 in the embodiment, the invention is applicable to the structure in which the relay conveyor unit 11*b* is constituted as a part of the sheet post-processing device 12 and is attached to the main body 11*a* (except for the relay conveyor unit 11*b*) together with the sheet post-processing device 12. In that case, if the slide contact guide 53, the follower guide 57, and the pair of fixed guides 49 are provided between the main body 11*a* (except for the relay conveyor unit 11*b*) and the relay conveyor unit 11*b*, then the same function as the aforementioned embodiment may be achieved.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. An image forming apparatus, comprising:

a main body having a delivery section for delivering a paper sheet with a toner image transferred thereon to an outside; and a sheet post-processing device having a reception section for receiving the paper sheet delivered from the delivery section of the main body, wherein the delivery section has a first sheet path for conveying the paper sheet into the delivery section, and a first paper conveying unit for conveying the paper sheet toward the reception section, wherein the reception section has a pair of fixed guides which is fixed so as to open to the first paper conveying unit for receiving the paper sheet conveyed from the first paper conveying unit, and a second sheet path which continues from the pair of fixed guides, and wherein a pair of movable guides is provided between the first paper conveying unit of the delivery section and the pair of fixed guides of the reception section so as to be able to rotate around a horizontal shaft, and when the sheet post-processing device is brought close to the main body, the pair of movable guides comes into sliding contact with the pair of fixed guides and rotates around the shaft.

2. The image forming apparatus as in claim 1, wherein the shaft is provided in an end portion of the pair of the movable guides which is opposite to the pair of the fixed guides.

3. The image forming apparatus as in claim 1, wherein a second paper conveying unit is provided which conveys the paper sheet, which are conveyed into the reception section from the first paper conveying unit via the pair of movable guides and the pair of fixed guides, toward a downstream in the sheet post-processing device, and wherein the second paper conveying unit comes into contact with one side of the paper sheet at a nip portion.

4. The image forming apparatus as in claim 1, wherein the pair of movable guides comprises: a slide contact guide which comes into sliding contact with the pair of fixed guides and rotates around a shaft when the sheet post-processing device is brought close to the main body; and a follower guide which follows after rotation of the slide contact guide and rotates around a shaft, and wherein a notch portion is provided in a downstream end portion of the follower guide, and an elastic member is placed on the notch portion.

5. The image forming apparatus as in claim 4, wherein the follower guide is biased toward the slide contact guide by a movement restraining member placed in a stationary section of the main body.

6. The image forming apparatus as in claim 4, wherein a projection extending toward either one of the slide contact guide and the follower guide is provided in the other guide so that a paper sheet path is formed between the slide contact guide and the follower guide.

7. The image forming apparatus as in claim 1, wherein the pair of movable guides comprises: a slide contact guide which comes into sliding contact with the pair of fixed guides and rotates around a shaft when the sheet post-processing device is brought close to the main body; and a follower guide which follows after rotation of the slide contact guide and rotates around a shaft, and wherein a notch portion is provided in a downstream end portion of the follower guide, and a rotating member which rotates around a shaft from a horizontal state to a state in contact with the notch portion is placed on the notch portion.

8. The image forming apparatus as in claim 7, wherein the follower guide is biased toward the slide contact guide by a movement restraining member placed in a stationary section of the main body.

9. The image forming apparatus as in claim 7, wherein a projection extending toward either one of the slide contact guide and the follower guide is provided in the other guide so that a paper sheet path is formed between the slide contact guide and the follower guide.

* * * * *